United States Patent [19]

Long et al.

[11] Patent Number: 4,760,881

[45] Date of Patent: Aug. 2, 1988

[54] DOWNHOLE STEAM SAMPLER

[75] Inventors: Stephen L. Long; Gene L. Christ, both of Houston, Tex.

[73] Assignee: Texaco Inc., White Plains, N.Y.

[21] Appl. No.: 20,834

[22] Filed: Mar. 2, 1987

[51] Int. Cl.[4] ..... E21B 49/08

[52] U.S. Cl. ..... 166/165; 73/863.21; 73/864.63; 166/264

[58] Field of Search ..... 166/162, 165, 167, 168, 166/264; 73/863.21, 863.52, 863.53, 864.63

[56] References Cited

U.S. PATENT DOCUMENTS

| | | | |
|---|---|---|---|
| 2,870,844 | 1/1959 | Barnes | 166/165 |
| 2,879,850 | 3/1959 | Exline | 166/166 |
| 3,459,263 | 8/1969 | Drivet | 166/165 |
| 3,934,469 | 1/1976 | Howard et al. | 166/264 |
| 3,981,189 | 9/1976 | Howard et al. | 166/264 X |
| 4,254,830 | 3/1981 | Garney et al. | 166/162 |

*Primary Examiner*—Stephen J. Novosad

*Attorney, Agent, or Firm*—Robert A. Kulason; James J. O'Loughlin; Robert B. Burns

[57] ABSTRACT

A downhole steam sampler for collecting the liquid phase content of a steam flow, immediately prior to the latter being injected into a substrate surrounding a hole or well. A reservoir within the sampler separates and retains the liquid phase while permitting the vaporous phase to pass. Detent means cooperates with a pair of spaced apart flow control valves to permit said valves to be closed simultaneously when the steam sampling operation is completed.

8 Claims, 3 Drawing Sheets

FIG. 1
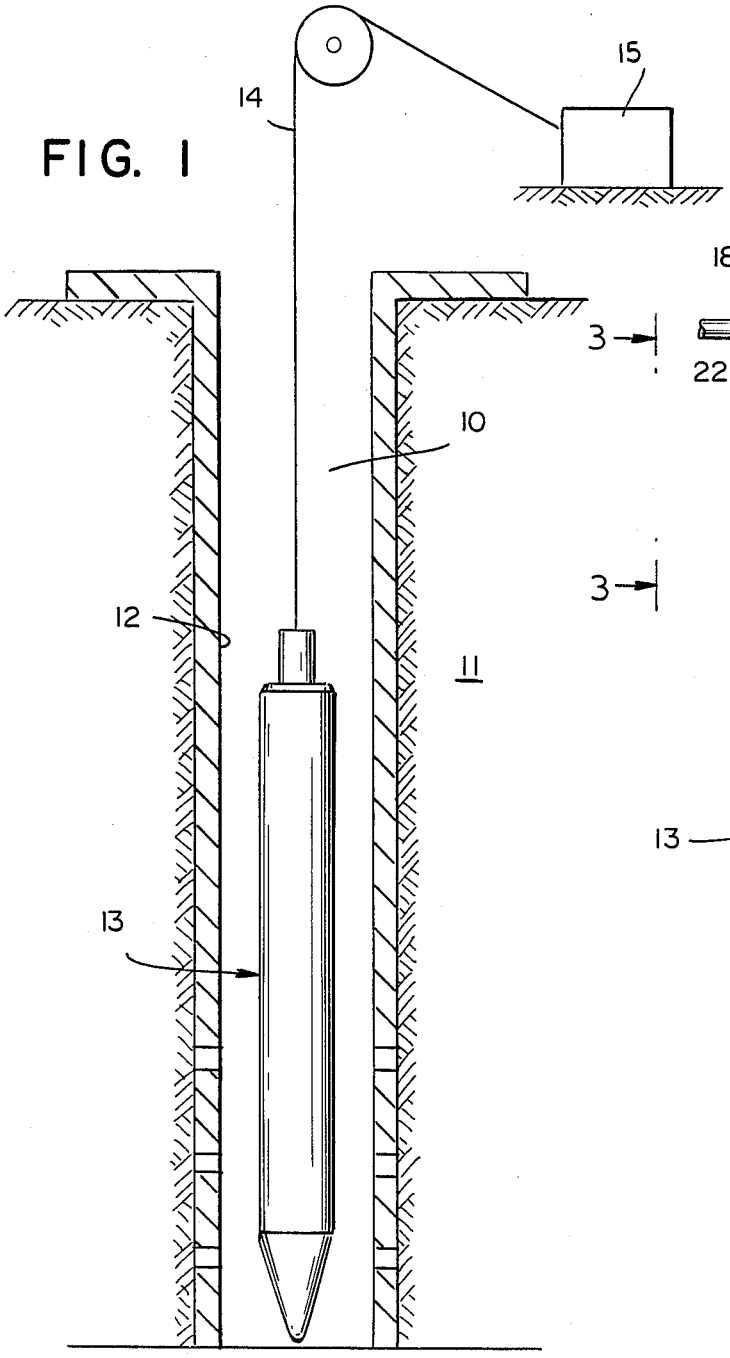
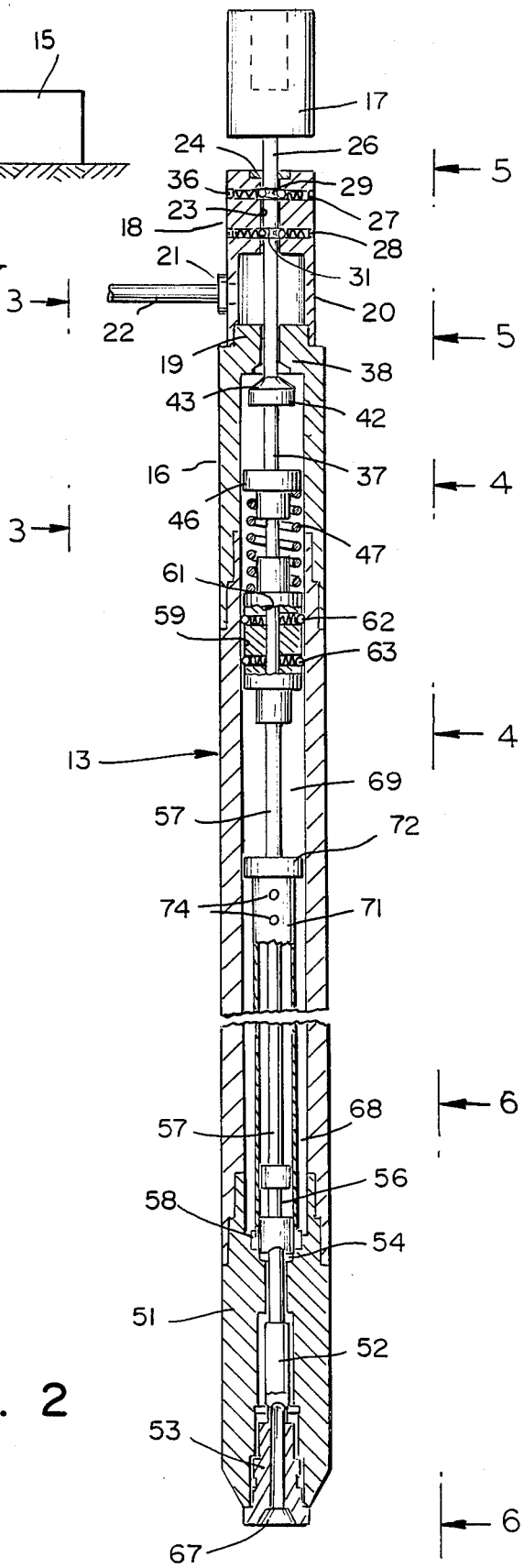
FIG. 2

DOWNHOLE STEAM SAMPLER

BACKGROUND OF THE INVENTION

In the production of carbonaceous products such as crude oil and the like, the viscosity of the latter and the condition of the subterranean reservoir in which it is held, often demand that some form of enhancement be utilized. Among the more common forms of enhancement is the injection of steam into the substrate at a sufficient pressure to penetrate the latter and to fluidize the carbonaceous product. The steam also forms a pressurized barrier to drive production fluids in a particular direction toward a producing well or wells.

It is desirable in conducting such a steaming operation, to determine the quality of the steam as it enters the substrate. The latter can normally be at a location any depth along the borehole, well or the like. The determination of steam quality is an economic expedient since the steam will be delivered to the borehole upper end from a source, in a known condition. By the time it flows through the well bore, however, and is in position to enter the substrate, the quality will normally be reduced. Without an accurate determination of quality, it is difficult to estimate the amount of heat being delivered to the substrate.

In brief, what this means is that an oil field steam generator normally produces "wet steam". The steam is not 100% vapor; it contains a liquid phase. Steam quality is a measure of the mass of vapor to the total mass of steam. It is therefore accurate to refer to the vapor phase or the liquid phase of wet steam.

Generally speaking, feed water to a steam generator contains a certain amount of dissolved solids such as salt, i.e. sodium chloride. When the water is turned into wet steam the sodium chloride cannot be contained in the vapor phase; it must be carried in the liquid phase. Therefore the salt content becomes concentrated in the liquid phase.

The higher the steam quality (more vapor phase to liquid phase), the more concentrated the salt content becomes. To measure steam quality, the sodium chloride content of a sample of the liquid phase is ratioed to the sodium chloride content of the feed water. The amount of condensation that occurs does not affect the presently disclosed tool or steam sampler. This tool functions to measure the amount of condensation (i.e. loss of steam quality).

The prior art has disclosed a number of downhole steam samplers which have been successfully utilized. These are used generally for withdrawing a sample of the liquid phase of steam for a steam flow to a well. The sample, when withdrawn from the well, can be analyzed for its chloride ion count as an aid toward establishing an accurate determination of the quality of the steam as it enters the substrate.

In the presently disclosed arrangement, a steam sampler is disclosed which is both durable in structure and relatively simple to operate. The sampler, or tool, is comprised primarily of an elongated casing which is lowered preferably within a lubricator or the like, by a wire line to a particular position or level within a well or borehole. The sampler casing includes an inlet at the upper end for admitting steam at a high pressure and temperature. A discharge opening at the casing lower end directs the pressurized flow into the adjacent subterranean reservoir.

Detent regulated controls maintain the valves in open position and the steam passage unobstructed.

The steam sampler incorporates a fluid separator which permits the liquid phase content to fall by gravity into a container, reservoir or receptacle. The vaporous segment will continue downwardly and be directed from the sampler's discharge opening.

The flow of steam through the elongated casing is regulated by at least one, and preferably by two consecutively positioned flow control valves. Each of said control valves is provided with closure means in the form of a shaft having the detent means. Each said shaft includes a seal member, and preferably a seal member characterized by a metallic seal face, to best mate with a corresponding metal seat formed into the casing.

While a flow of steam passes through the open flow control valves, during a set time period the liquid phase will accumulate in the sampler collecting reservoir. At the end of the set period, flow of steam through the sampler is terminated in a manner to permit the sampler and lubricator to be withdrawn from the well, yet permit continued steam injection into the substrate.

Closure of the flow control valves is triggered by a detent mechanism which functions in conjunction with each valve shaft or shafts. Valve closing is achieved by a physical uplifing of the sampler to a predetermined height, (approximately 10 feet), permitting it to fall, and abruptly halting the fall. The downward momentum and sudden halt will overcome the detent force which retains the respective valve shafts in open position, release of the valve shafts to detents and terminate further steam flow through the fluid separator.

It is therefore an object of the invention to provide a steam sampler of the type contemplated which is responsive to surface induced actuation for closing steam flow control valves.

A further object is to provide a steam sampler which is capable of effective operation in spite of excessively high temperature steam being passed therethrough and which would ordinarily adversely affect internal flow control valves.

A still further object is to provide a steam sampler having metal-to-metal valve seating surfaces which are actuated into engagement with corresponding valve seats to achieve the desired termination of steam flow through the unit.

DESCRIPTION OF THE DRAWINGS

In the drawings,

FIG. 1 is an environmental view in partial cross-section of a steam sampler in a well bore.

FIG. 2 is an enlarged cross-sectional view of a steam sampler.

Referring to FIG. 1, a well bore or hole 10 is illustrated as formed into a substrate 11. The latter is characterized by a reservoir holding a hydrocarbon fluid which is to be removed with the aid of a thermal enhancement procedure. Well 10 in the usual manner, is formed by a series of vertical casings 12, the inner one of which extends downwardly through one or more productive levels at which the casing is perforated, and which are to be treated by steam injection from a source 20.

Figure 3:
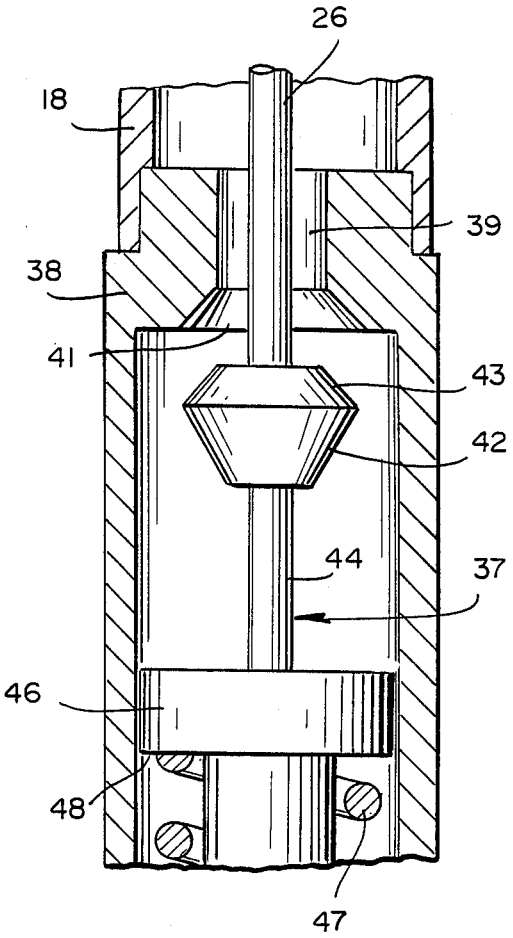
FIG. 3 is an enlarged cross-sectional view of the seal carrier of FIG. 22

The steam sampler 13 is shown suspended by a wire line 14 or other member which can be controlled from the ground. Thus, the vertical position of the sampler in well casing 12 can be regulated, and the respective steam flow control valves can be actuated to closed position when required.

Referring to FIG. 2 steam sampler 13 is comprised of an elongated steel casing 16 having opposed upper and lower connected sections which can be formed of a plurality of axially aligned, individual tubular members. Casing 16, as noted, is capable of being suspended in the well by wire line 14 to permit vertical movement by a wire line winch 15 or by a sucker rod coupling 17 which threadably engages the sampler as will be hereinafter noted.

Casing 16 upper end is provided with a removable cap 18 which can threadably engage a protruding hub 19 at the casing upper end. Cap 18 includes one or more inlets 21 which receive high pressure steam from a source which feeds the well. Cap 18 further includes an end wall having an axial passage 23 which registers an upper valve shaft 26.

A plurality of detent means 27 and 28 formed in said cap 18 upper wall, extend normal to shaft 26 to engage the latter and displaceably retain it in a retracted position.

Figure 5:
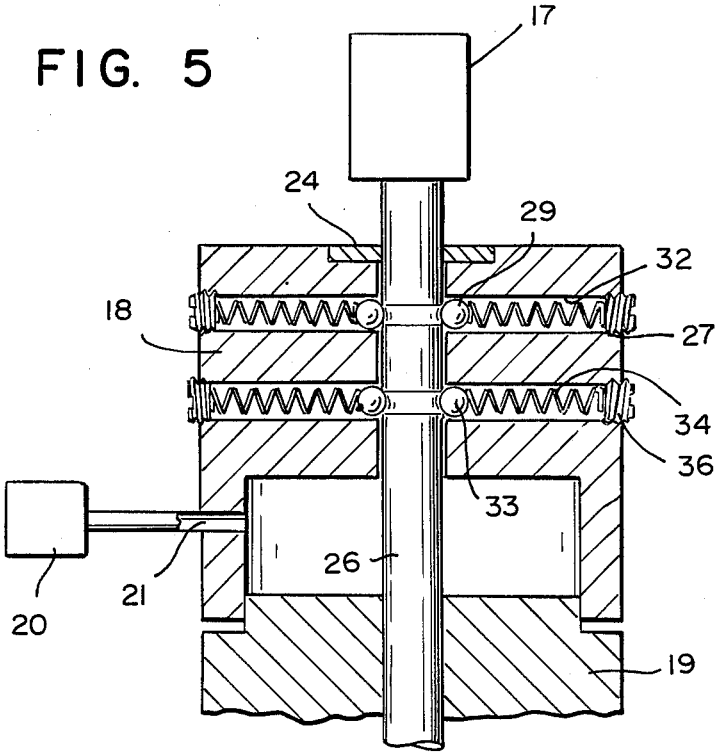
FIG. 5 is an enlarged cross-sectional view of the upper end of the apparatus including the detent, as shown in FIG. 2
Figure 6:
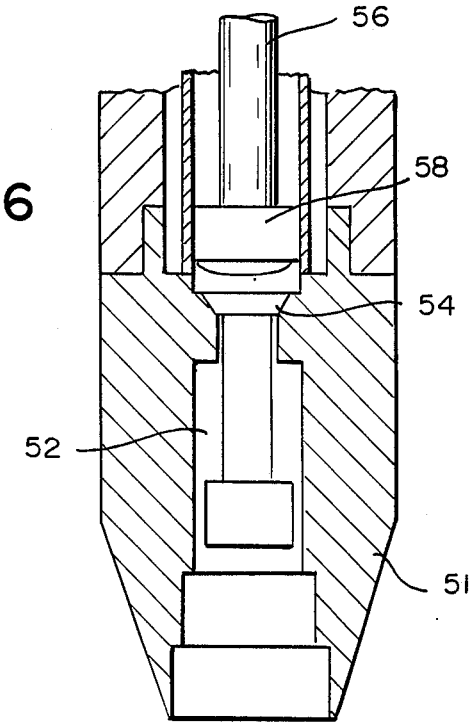
FIG. 6 is an enlarged cross-sectional view of the lower end of the apparatus shown in FIG. 2.

Referring to FIG. 5, in one embodiment detent means 27 and 28 is comprised of at least one and preferably two spaced apart detent annular recesses 29 and 31 formed in the upper valve shaft 26. Each detent, 27 for example, is provided with one, and preferably with two, axially aligned threaded passages 32, which terminates at shaft 26. The latter extend inwardly to confine a ball 33 which is retained in detent recess 29 by a compression spring 34. Spring 34 is retained by a plug 36 threadably engaged in passage 27.

Operationally, inward adjustment of threaded plug 36 compresses spring 34 to urge detent ball 33 into the detent annular recess 29. However, in the normal function of such an arrangement, the intertial force which maintains shaft 26 in valve open position, is overcome when the sampler 13 is caused to drop, and downward movement suddenly stopped. The latter action displaces the respective detent balls 33 from shaft 26 which can adjust to close its flow control valve.

The lower end of the upper valve shaft 26 can be threaded or otherwise adapted to removably engage a seal carrier 37 which will be herinafter described.

Referring to FIG. 3, elongated casing 16 is provided at its upper end with an end wall 38 having an access passage 39 which terminates in an enlarged valve port 41. As noted herein, upper valve shaft 26 threadably engages the seal carrier 37. The latter includes an enlarged head 42 which supports a tapered seal ring 43, providing a tapered seating surface which will engage the corresponding valve port 41 when shaft 26 is urged into closed position.

Seal carrier 37 further includes a body 44 having an enlarged hub 46, the lower end of which slidably registers with the inner wall of casing 12. Hub 46 is adapted to receive one end of compression spring 47 at shoulder 48. Hub 46 is provided with one or more longitudinal passages, not presently shown, to permit steam flow therethrough.

Referring to FIG. 2, the lower end of casing 16 includes a nose piece 51 which has an axial passage 52. Said passage is threaded at the outer end to removably receive a sample valve connection member 53. The latter includes a body having a threaded shank which engages a threaded bore in the nose piece 51, and further conformed to accommodate a sampling valve which can be provisionally inserted therein.

Nose piece 51 is provided with a lower flow control valve port 54 port positioned coaxially of the nose piece. A lower valve carrier 56 is threadably engaged with one end of lower valve shaft 57 and further includes a head 58 which sealably engages the lower flow control valve port 54. Valve head 58 can be fabricated as in the above noted flow control valve head 42, with a tapered metallic engaging surface which, when in the closed position, forms an annular seal to close the casing central passage to the flow of steam.

Figure 4:
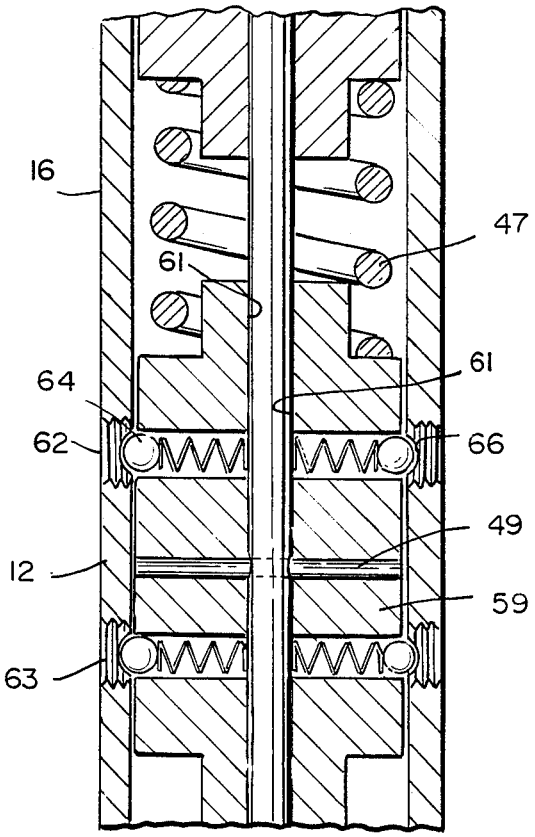
FIG. 4 is an enlarged cross-sectional view of the counter weight and its associated detents shown in FIG. 2

Referring to FIG. 4, the opposite or upper end of the lower valve shaft 57 is provided with a counterweight 59 in the form of an elongated body having a central passge 61. The latter registers the lower valve shaft 57 which is fixed to the counterweight by one or more transverse pins 49.

Counterweight 59 includes a peripheral surface which is slidably positioned contiguous with the inner wall of casing 12 to be reciprocally movable therein. The relationship between counterweight 59 and the lower shaft 57 is fixed to permit both said members to act as a unit. However, the entire lower valve shaft assembly, including the counterweight 59, is longitudinally slidable within casing 12 for a limited degree to effect closure of the lower flow control valve whereby to terminate steam flow from the sampler outlet.

Casing 12 central passage defines a continuous steam conduit between the upper and the lower ends thereof. Counterweight 59 is therefore provided with at least one, and preferably with a series of longitudinal bores, not presently shown, which communicate the upper end of said casing with the lower end to allow steam flow.

Casing 16 lower end further embodies a liquid holding reservoir 68 in the form of an elongated perforated tubular 71 which is engaged with nose piece 51, and which extends for a distance along the casing wall to terminate at an enlarged flange 72. The latter is positioned against the casing 16 inner wall, but is provided with passages to permit flow of the hot steam from the intermediate chamber 69, downward into the lower annular chamber 68 or reservoir between the casing wall and the tubular 71.

Functionally, as wet steam enters the annular chamber 68, a part will be in liquid phase and will flow in liquid form into chamber 68, progressively filling the latter. As a result of this fluid separation, the liquid-free vapor will pass through the lateral openings 74 in tubular 71. It will then pass downwardly by way of openings formed in lower seal carrier 56, to exit by way of flow control valve 54, from the nose piece 51 to enter the adjacent substrate.

Referring again to FIG. 4, to permit the provisional retention of couterweight 59 within elongated casing 12 during steam flow, the counterweight is provided with one, and preferably with a plurality of radially extending detent means 62 and 63. Said detent means, 62 for example, as in the instance of the detent regulating the upper flow control valve, includes a ball 64 which is urged into engagement with an access groove or ring 66 formed in the casing inner wall.

Detent means 62 and 63 are preferably spaced longitudinally along counterweight 59 to permit the entire valve shaft 57 a degree of longitudinal movement. Thus, when actuated in response to a jarring movement of the sampler, counterweight 59 will be dislodged from ascess ring 66, thus permitting lower valve shaft 57 to be urged downwardly. The shaft 57 lower sealing head 58 will engage the corresponding valve port 54 to complete an annular vapor tight seal.

Operationally, when it is desired to determine the quality of steam being injected into substrate 11 at some level of well bore 10, a sampler 13 is lowered, preferbly through a lubricator during the steaming operation, to that point in the well casing 12 where the injection is taking place. The elongated sampler casing 12 is lowered on wire line 14 into the well bore and suspended with the discharge opening 67 adjacent to the approximate point of delivery.

In anticipation of such an operation, sampler 13 while still at the surface, is initially primed or preset for lowering into well bore 10. This is achieved by initially opening both the upper and lower flow control valves. The lower flow control valve is preset into open position by threadably inserting sample valve connection 53 to rotatably position it against the lower end of lower valve shaft 57. Shaft 57 is thereby lifted, allowing detent balls 64 in counterweight 59 fall into place in the respective detent grooves or recesses 66 in casing 12 inner wall.

Concurrently, the upper flow control valve is preset to open position by urging the upper shaft 26 downwardly into the casing 12 until detent means 27 and 28 register with grooves 29 and 31. At this point, both the upper and lower flow control valves are in the open position, and spring 47 is compressed between upper seal carrier 37 and the counterweight 59. Spring 47 is compressed to the point where the components of the respective detents are in equilibrium and the respective flow valves will remain in an open position by the restraining detent forces.

Steam from the pressurized source 20 will be forced into well bore 10 and enter longitudinal openings 22 in hub 19 and wall 38, to enter the upper flow control valve.

The wet steam then passes through upper flow control valve port 41, and the longitudinal passages formed in counterweight 59. The wet steam passes thence into intermediate passage 69.

After a set time period during which the liquid phase is separated and collected from the steam flow, sampler 13 is raised on wire line 14 about 10 feet. The wire line is then relaxed to permit casing 12 to drop. As the sampler is brought to an abrupt stop, the sucker rod coupling 17 will exert a sufficient upward force on valve shaft 26, that detents 27 and 28 will be displaced, permitting the upper flow control valve to close.

Concurrently, as the fall of casing 12 is halted, the downward momentum of counterweight 59 will overcome the restraining force of the spring loaded detent means 62 and 63 thereby permitting the counterweight 59 and shaft 57 to drop until lower flow control valve closes. In this position, both upper and lower flow control valves will be closed with spring 47 urging and holding both said valves in the closed position. The sampler can then be removed to the surface by retracting wire line 14 until the sampler 13 is accessible at the surface.

It is understood that although modifications and variations of the invention can be made without departing from the spirit and scope thereof, only such limitations should be imposed as are indicated in the appended claims.

We claim:

1. In a downhole steam sampler for collecting the liquid phase component from a flow of wet steam which is injected into a substrate reservoir by way of a borehole formed into said substrate, which sampler includes an elongated casing having opposed upper and lower ends, and which define a steam flow passage, an inlet port at the casing upper end for receiving a flow of wet steam, an outlet port in the casing lower end for discharging steam without the liquid phase component, from the casing, upper and lower control valve means in said steam flow passage, being actuatable between open and closed modes to regulate the flow of steam through said steam flow passage, separate upper and lower valve shafts extending from the flow control valve means longitudinally of the elongated casing, and detent means engaging said respective upper and lower valve shafts with said casing to maintain the respective flow control valve means in open position, said detent means being displaceable to disengage the valve shafts from the casing to permit the respective valves to be actuated to closed position.

2. In the apparatus as defined in claim 1, wherein the upper and lower valve shafts are disposed in substantial axial alignment in said casing.

3. In the apparatus as defined in cliam 2, including biasing means engaging the aligned upper and lower valve shafts to urge said respective valve shafts into the non-actuated position after being disengaged from the casing.

4. In an apparatus as defined in claim 1, wherein the respective flow control valve means includes at least two valve shifts disposed coaxially of the elongated casing.

5. In the apparatus as defined in claim 4, wherein the lower of said at least two valve shafts includes a counterweight depending therefrom and being longitudinally actuatable in said steam flow passage.

6. In the apparatus as defined in claim 1, wherein said at least two valve shafts are actuatable in opposite directions to close the respective flow control valves.

7. In the apparatus as defined in claim 1, wherein said biasing means includes a spring means positioned intermediate the respective upper and lower valve shafts.

8. In the apparatus as defined in claim 1, wherein the detent means is displaceable to permit the valve means to close in response to the casing being abruptly stopped from a downward motion.

* * * * *